US005398837A

United States Patent [19]

Degrassi

[11] Patent Number: 5,398,837

[45] Date of Patent: Mar. 21, 1995

[54] CELL CULTURE FLASK AND CLOSURE

[76] Inventor: Alberto Degrassi, Via Bassano No. 1, Feletto Umberto - Udiné , Italy, 33010

[21] Appl. No.: 45,538

[22] Filed: Apr. 9, 1993

[30] Foreign Application Priority Data

Feb. 15, 1993 [IT] Italy ..... TV93A0017

[51] Int. Cl.[6] ..... B65D 43/14

[52] U.S. Cl. ..... 220/337; 220/300; 220/375; 215/306; 215/332

[58] Field of Search ..... 215/306, 332; 220/293, 220/300, 375, 337

[56] References Cited

U.S. PATENT DOCUMENTS

| | | | |
|---|---|---|---|
| 283,436 | 8/1883 | Thatcher et al. . | |
| 2,257,682 | 9/1941 | Hermani . | |
| 2,271,630 | 2/1942 | Dahlgreen . | |
| 2,307,028 | 1/1943 | Dahlgreen . | |
| 2,971,045 | 2/1961 | August . | |
| 3,117,702 | 1/1964 | Henchert . | |
| 3,181,725 | 5/1965 | Friedl | 220/375 X |
| 3,199,707 | 8/1965 | Folkman . | |
| 3,297,184 | 1/1967 | Andelin . | |
| 3,407,956 | 10/1968 | Linkletter et al. . | |
| 3,416,688 | 12/1968 | Fanning . | |
| 3,870,602 | 3/1975 | Froman et al. | 195/139 |
| 4,054,221 | 10/1977 | Glover . | |
| 4,082,201 | 4/1978 | Bittel . | |
| 4,291,818 | 9/1981 | Nozawa et al. . | |
| 4,387,821 | 6/1983 | Geiger | 215/332 X |
| 4,399,928 | 8/1983 | Klingler . | |
| 4,473,170 | 9/1984 | Ciancimino | 220/300 |
| 4,534,483 | 8/1985 | Kassis et al. . | |
| 4,742,928 | 5/1988 | Braun . | |
| 4,896,780 | 1/1990 | Jessop et al. . | |
| 4,919,286 | 4/1990 | Agbay, Sr. . | |
| 4,935,371 | 6/1990 | Rickloff . | |
| 5,078,296 | 1/1992 | Amidzich . | |
| 5,145,646 | 9/1992 | Tyranski . | |

FOREIGN PATENT DOCUMENTS

| | | | |
|---|---|---|---|
| 151071 | 5/1937 | Austria | 215/306 |
| 0337677 | 4/1989 | European Pat. Off. . | |
| 1372433 | 8/1964 | France . | |
| 2137065 | 3/1972 | Germany . | |
| 2412439 | 9/1975 | Germany | 220/375 |
| 692418 | 7/1965 | Italy | 215/306 |

*Primary Examiner*—Allan N. Shoap
*Assistant Examiner*—Jes F. Pascua
*Attorney, Agent, or Firm*—Leydig, Voit & Mayer

[57] ABSTRACT

A cell culture flask having a hinged closure including a closure top which covers the flask opening and a locking arrangement to hold the closure top in the closed position. A finger tab is provided which extends radially from the closure top for manipulating the hinged closure to engage or release the locking arrangement, which may be snap-type or bayonet-type, and to move the closure top between the closed and fully open positions solely by one finger when the flask is held by the remaining four fingers and within the palm of one hand providing access to inside the flask for a pipette or the like held in the other hand through the flask opening. An elongated portion of the finger tab extends radially when the closure top is in the closed position and presents a radial extension which provides leverage to allow movement by one finger to pivot the hinged closure and to move it axially, to engage or release the locking arrangement, and to move it between the closed and fully open positions.

18 Claims, 6 Drawing Sheets

CELL CULTURE FLASK AND CLOSURE

TECHNICAL FIELD

This invention relates to flasks for maintaining cell cultures in vitro and, more particularly, to such flasks with closures which must be moved to open positions away from axial projections of the flask openings to allow the withdrawal or injection of tissue culture media through the flask openings.

BACKGROUND OF THE INVENTION

Presently, laboratories working with cell cultures use plastic disposable vessels; such vessels have different shapes such as cylindrical bottles, flat round dishes or polygonal (e.g., triangular) flasks. Polygonal flasks are the most widely used in tissue culture for a number of reasons. For example, the surface area may be changed by using them in the upright or the flat position. Conventionally, this type of vessel has a closure or cap that can be closed air tight once the flask is in a non-sterile environment and can be left partially open when the flask is in a sterile incubator or the like to allow gas circulation in the flask (necessary to maintain the appropriate pH).

During the manipulation of the flask (seeding of cells, change of tissue culture medium etc.) the surface of potentially contaminated or contaminable area is smaller that in some other type of vessels such as tissue culture dishes wherein the lid has to be completely removed to allow manipulation of cells and thus the whole surface of a cell culture is exposed to contamination by external agents.

Flasks that are commercially available at the present time are all characterized by a screw cap positioned on the flask's neck which is on the top of a containment chamber. The use of a screw cap as a flask closure presents several practical problems, as follows:

1. Sterility

Most of the manipulations of cell culture flasks are performed under a sterile hood where a vertical laminar flow of sterile air blows down from the top of the cabinet onto the work surface and is drawn through the work surface and either recirculated or vented. Any object that interrupts the air flow cause a turbulence in the area below the object; turbulence draws in surrounding air which is not sterile. Furthermore, objects and instruments (including the hands of the operator) used under the hood, are sometimes not sterile; thus they can release small particles of powder or other materials that contain contaminating particles.

2. Training

The operators usually handle the samples to be injected in or withdrawn out of cell culture flasks using electrical instruments called pipettors; such instruments allow controlled dispensing of liquids through disposable pipettes. This means that an operator has one hand fully occupied working with the pipettor leaving the other hand for all the operations necessary to unscrew, open, displace, replace, close and screw the cap of the flask. These operations need to be done in such a way that no contaminated surfaces (external part of the cap, fingers, etc.) contact the top of the open flask and require a lot of operator training to be properly performed.

3. Contamination of the Sample/Operator

Still, a well trained operator can either contaminate the flask neck or be contaminated by the microorganisms present on the flask neck if the flask or the closure must be handled in a non-sterile area away from the sterile atmosphere below the hood, or if the flask closure is placed in the non-sterile outside area while the flask is manipulated. Sometimes this becomes necessary because of the difficulty in handling the flask and screw type closure.

4. Working Speed

Operations such as injecting and withdrawing of samples, and removing and replacing closures, can be properly done with a screw-type closure only by using both hands; this is not always possible and when it is possible, it is inevitably slow.

5. Contamination of the Working Area

Furthermore, if two hands are used the cap has to be placed on the surface of a bench outside the sterile area while operating with the flask; this exposes the cap either to be contaminated by external agents or to contaminate the bench or other objects in the working area.

One example of a cell culture flask with a screw cap which is also hinged to the flask so as to be movable by the finger of one hand to an open position after the cap has been unscrewed, while the flask is held by the same hand, is disclosed in Kassis et al. U.S. Pat. No. 4,534,483. To provide a reuseable cap this patent discloses a screwcap connected to the flask by an orientation strip which is attached to a collar which encircles the neck of the flask and freely turns about the neck to allow the cap to be threaded onto threads outside the neck of the flask. To open such a cap from the closed position requires two hands, one to hold the flask and one to unscrew the cap. As above noted, this requirement to use two hands to open the cap on the flask raises numerous practical problems.

SUMMARY OF THE INVENTION

It is the principle object of the invention to provide a cell culture flask having a hinged closure and locking means which may be manipulated to engage or release the locking means and to move the closure between the closed and fully open positions solely by one finger when the flask is held by the remaining four fingers and within the palm of one hand.

A related more specific object is to provide a cell culture flask having a hinged closure which may be manipulated by a finger tab solely by one finger of the same hand which holds the flask to open or close the closure.

Another object is to provide a cell culture flask having a hinged closure with a venting means when the closure is closed.

Another object is to provide a cell culture flask having a hinged closure with a snap-type locking means or with a bayonet-type locking means.

Another object is to provide a cell culture flask having a hinged closure which, when the flask is upright, is held in a fully open position by its own weight.

More specifically, a still further object is to provide a cell culture flask comprising a container having a neck, the neck having an axis and an opening in an opening plane transverse to the axis providing access to inside the container for a pipette or the like through the neck opening, a hinged closure having a top which covers the neck opening, and a flange which depends from the top outside the neck opening when the closure top is in a closed position, the flange having a locking lug which projects laterally from the flange, closure hinge means and locking means secured to the neck including: a hinge member supporting the closure top for pivotal movement from the closed position to a fully open position at which it and the flange are located away from an axial projection of the neck opening, a locking element outside the neck which locks the closure top in the closed position after the closure flange is moved axially onto the neck by engaging and resisting movement of the locking lug, and means for manipulating the closure to engage or release the locking means and for moving the closure top between the closed and the fully open positions solely by one finger when the flask is held by the remaining four fingers and within the palm of one hand including: a finger tab which extends longitudinally from the closure top at a location adjacent the hinge member in a direction generally parallel to the opening plane, when the closure top is in the closed position, and in a direction generally perpendicular to the opening plane, when the closure top is in the fully open position, the finger tab presenting an extension which allows the one finger of the one hand to move the closure top, when locked in the closed position, solely via force produced by the one finger, applied to the finger tab, and transmitted through the finger tab to the closure top in first and second stages, a first stage wherein the finger tab which extends from the closure top provides leverage to overcome resistance by the locking element to movement of the locking lug as the closure top is moved responsive to the force applied by the one finger in a direction which releases the locking lug from engagement by the locking element, and a second stage wherein the closure top is pivoted toward the fully open position.

BRIEF DESCRIPTION OF DRAWINGS

Other objects and advantages of the invention will be apparent from the following description taken in conjunction with the accompanying drawings, in which.

DETAILED DESCRIPTION OF THE BEST MODE AND ALTERNATIVE EMBODIMENTS

Figure 2:
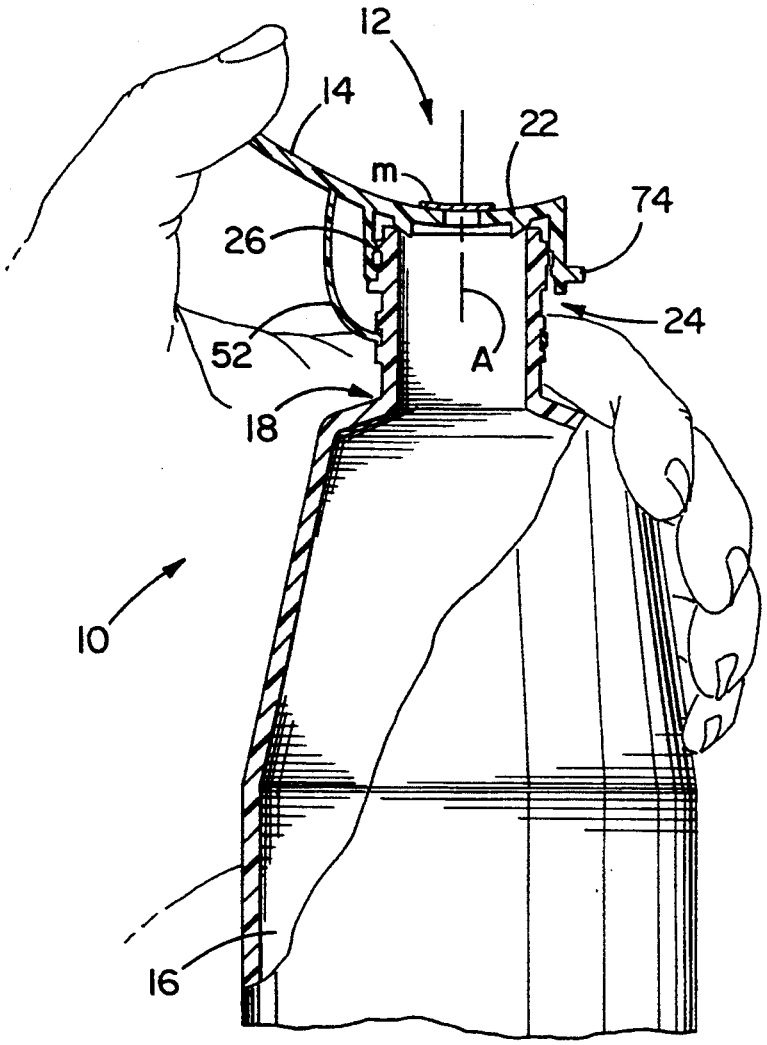
FIG. 2 is a side elevation with parts in section of a flask and closure according to the invention, illustrating how the flask is held in one hand and the closure is manipulated solely by one finger of the one hand to engage or release the locking means of the closure.
Figure 1B:
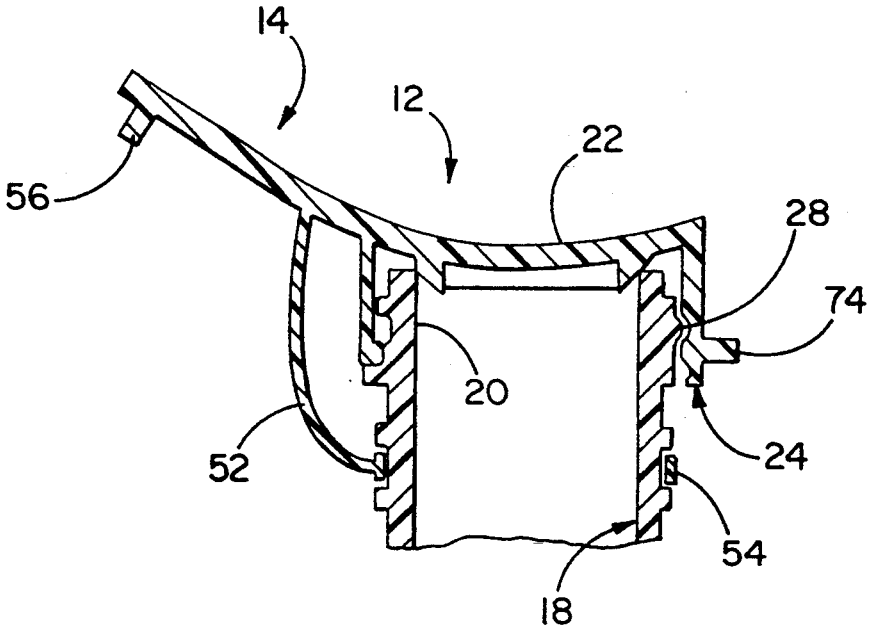
FIG. 1B is a view similar to FIG. 1A of another embodiment of flask and closure according to the invention with a vent passage to provide a venting means.

Turning to FIG. 2, a cell culture flask 10 having a hinged closure 12 constructed according to the invention is shown as having a finger tab 14 for manipulating the closure 12 solely by one finger (illustrated as the thumb) when the flask 10 is held by the remaining four fingers and within the palm of one hand.

The flask 10 has a container 16 with a neck 18, the neck having an axis A and an opening 20 in an opening plane transverse to the axis A. The opening 20 provides access to inside the container 16 for a pipette or the like through the neck opening 20 when the top 22 of the closure 12 is located, as shown in FIG. 4, in a fully open position at which the closure top 22 and a flange 24 which depends from the closure top 22 are located away from an axial projection of the neck opening.

Figure 3B:
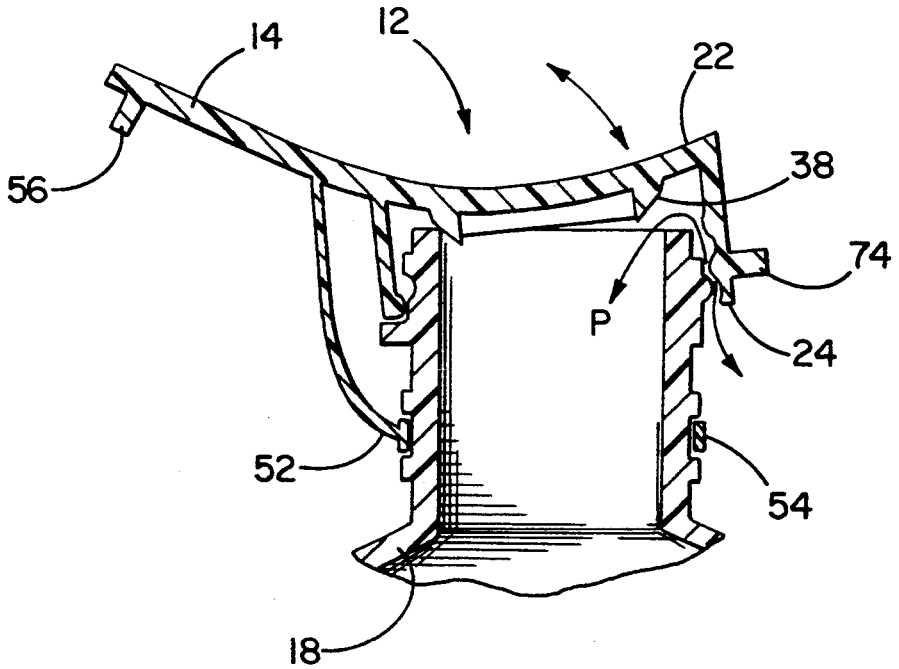
FIG. 3B is a view similar to FIG. 3A of the embodiment shown in FIG. 1B.
Figure 3A:
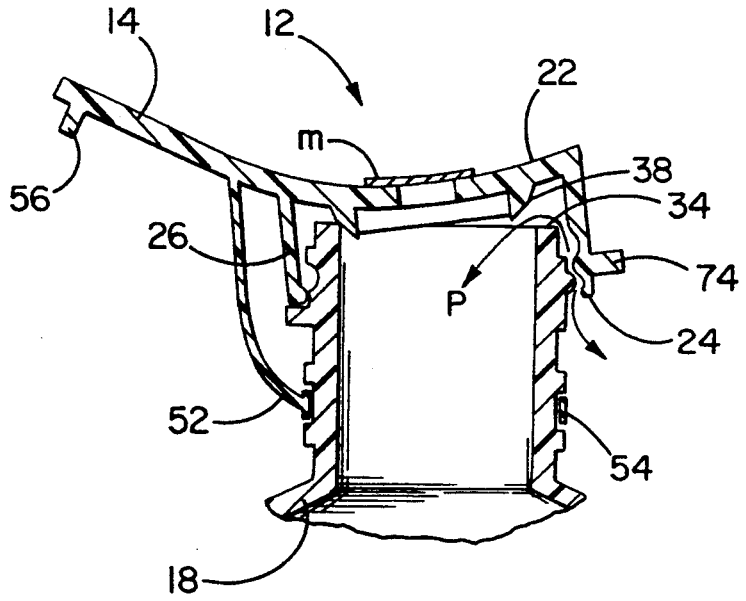
FIG. 3A is a view similar to FIG. 1A with the closure top held in a vented closed position on the flask neck by the locking arrangement, without being fully closed as shown in FIG. 1A.
Figure 4:
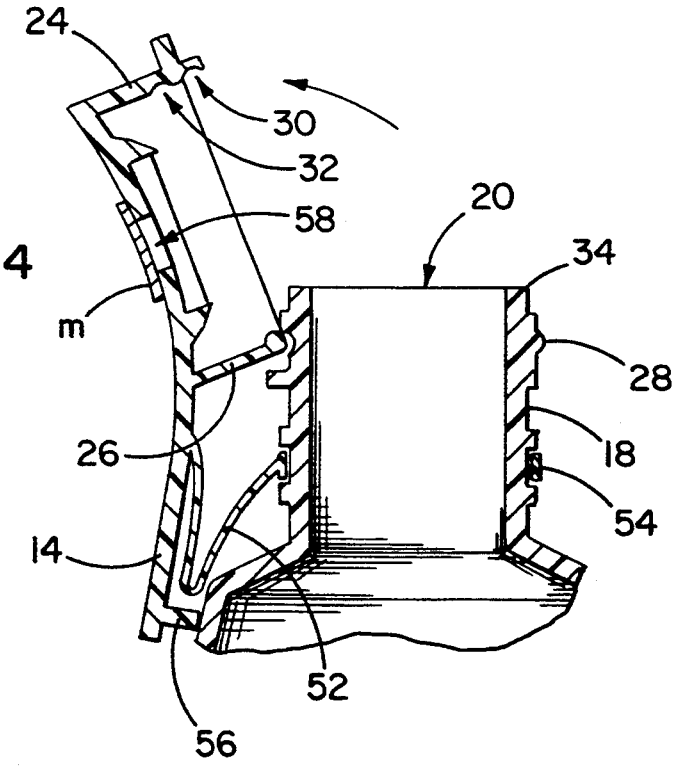
FIG. 4 is an enlarged fragmentary vertical sectional view of a flask and closure according to the invention with the closure top in a fully open position.

In carrying out the invention, closure hinge means and locking means are secured to the neck 18, herein shown as a hinge member 26 which supports the closure top 22 for pivotal movement from the closed position of FIG. 2 to the fully open position of FIG. 4, and a locking element 28 in the form of a ridge projecting from the neck 18 which locks the closure top 22 in the closed position after the closure flange 24 is moved axially onto the neck 18. For cooperation with the ridge locking element 28, which may be hemispherical, elliptical or cylindrical and which preferably extends only partially around the neck 18 in the region opposite the hinge member, the flange 24 which depends from the closure 22 is provided with two curved seats 30, 32. The first seat 30, shown as a curved recess inside the flange 24 in FIG. 4, is constructed to fit the ridge locking element 28 as shown in FIG. 3A when the closure top is pivoted toward the closed position and moved axially onto the neck 18 and to cooperate therewith to hold the closure top closed. In this first closed position, maintained by the first seat 30, a passage P (FIG. 3A) is present between the sealing surfaces of the closure top 22 and the top edge 34 (FIG. 4) of the neck 18 which allows flow of gas between inside and outside the container 16. Thus, the first closed position is a vented closed position. The second seat 32, also shown as a curved recess inside the flange 24 in FIG. 4, is constructed to fit and cooperate with the ridge locking element 28 after the closure flange 24 is pushed further axially onto the neck 18 to the position shown in FIG. 1A and FIG. 2. By a snap action an inwardly projecting locking lug 36 between the two seats 30, 32 moves past the ridge locking element 28 and causes the second seat 32 to fit onto the ridge locking element 28, thereby locking the closure top 22 in a second closed position. In this second closed position, an annular sealing projection 38 on the underside of the closure top 22 fits inside the neck opening and forms a seal, effectively closing off the passage P.

Referring particularly to FIGS. 2, 3A, 4 and 5 closure hinge means constructed according to a first embodiment of the invention include the hinge member 26 which has a base portion 40 having horizontal, oppositely projecting hinge pins 42 (one is shown), and a mounting member 44 (FIG. 5) which is secured to the flask neck 18 being either integral therewith as shown in FIGS. 1–5, or supported thereon as a separate member, if desired. The mounting member 44 is slotted to receive the hinge pins 42 and position the hinge pins along the hinge axis (horizontal in FIGS. 1–5), the hinge pins 42 then being rotatably mounted on the mounting member 44 so that the closure top 22 may be pivoted between the closed and open positions solely by one finger when the flask is held by the remaining four fingers and within the palm of one hand, as shown in FIG. 2.

In the embodiment of the hinge means shown in FIGS. 1–5, the hinge pins 42 of the hinge member 26 are seated in a curved recess 46 of the mounting member 44 as the closure top is raised from the closed position (shown in FIGS. 1–3A) and shift to a second curved recess 48 as the closure top swings to its fully open position (shown in FIG. 4) passing through the lip 50 of the recess 46 while being retained in the recess 48 by an elastic link 52 which is secured to the neck 18 by a band 54.

In keeping with the invention, the elasticity of the link 52 and the location and arrangement of the hinge member 26 is such that in the fully open position of the closure top 22 (FIG. 4) the closure top 22 is held in that position with a projection 56 near the free end of the finger tab 14 abutting the outside of the flask 10. In the fully open position, it is desired that the closure top 22 including the flange 24 should be located away from the opening in the flask neck 18 so that a pipette may be inserted through the opening without contacting any part of the closure; to this end, the angle of inclination of the finger tab 14 relative to the closure top 22 must be sufficient (20°–30°) to tilt the closure top 22 completely clear of an axial projection of the flask opening when the free end of the finger tab is pressed against the flask, as shown in FIG. 4. It will be seen also that in the arrangement shown in FIG. 4 where the hinge axis is at the center of the hinge pins 42, the center of gravity (CG) of the closure top 22 is located outwardly, relative to the flask 10 of a vertical line passing through the hinge axis, and the weight of the closure top 22 thereby acts to hold the closure top 22 in the fully open position when the flask 10 is upright. In the fully open position (FIG. 4) the finger tab 14 extends substantially vertically and in a direction perpendicular to the plane of the opening 20 which is horizontal in the illustrated flask 10 when the flask is upright. In the fully closed position of FIG. 1, the finger tab 14 extends radially from the closure top 22 at a location adjacent the hinge member 26 in a direction (to the left in FIG. 1A) generally parallel to the opening plane, as shown in FIGS. 1–3. In the present case "generally parallel" includes a small (20°–30°) angle of inclination of the finger tab 14 relative to the closure top as shown which positions the finger tab 14 when the closure top is in the closed position within reach of one finger which may rest on the top edge of the finger tab at a point spaced from the hinge axis as shown in FIG. 1A and positions the finger tab 14 when the closure top is in the fully open position with its free end adjacent the flask.

Figure 1A:
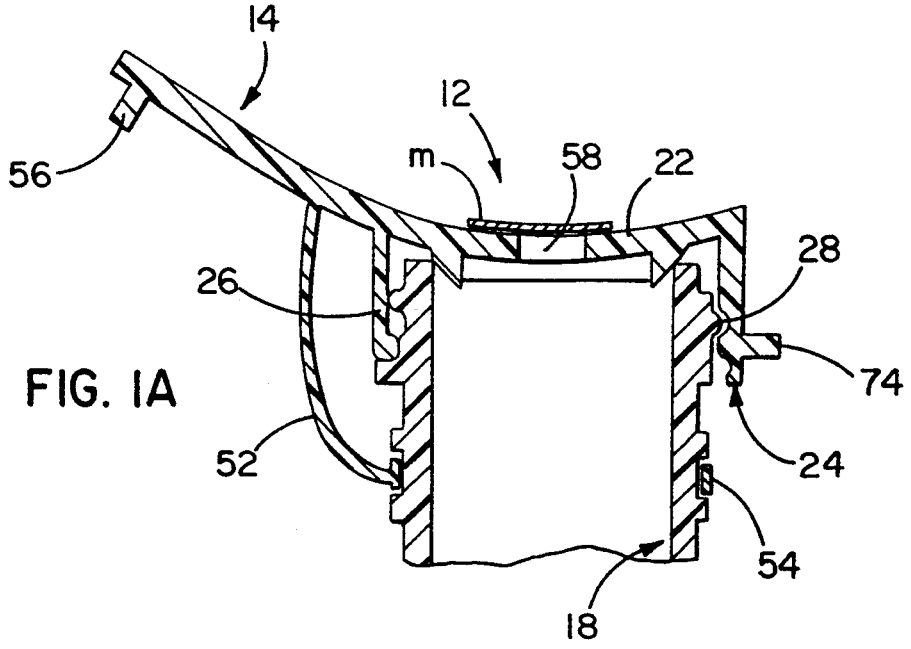
FIG. 1A is a vertical sectional view of one embodiment of a flask and closure according to the invention, illustrating the upper end of the flask neck with the closure secured in closed position by a snap-type locking means, the closure top having an opening and membrane covering the opening to provide a venting means.

Further in keeping with the invention, the finger tab 14 presents an extension which allows the one finger to apply force at a point spaced radially from the hinge (pivotal) axis of the closure top in a downward direction as shown in FIG. 1A which provides leverage to overcome resistance by the ridge locking element 28 to upward movement of the locking lug 36 as the closure top is moved responsive to the force applied by the one finger in a direction (upward in FIG. 1A) which releases the locking lug 36 from engagement by the locking element 28. It further will be noted that force produced by the one finger and applied to the finger tab 14 is through the finger tab to the closure top 22 in two stages, a first stage (between FIG. 1A and FIG. 3A) wherein the closure top is moved responsive to the force applied by the one finger in a direction (upwards) from the fully closed and locked position to the vented closed position of FIG. 3A, and then past the position of FIG. 3A when the locking lug 36 is released from engagement by the locking element 28, and a second stage (between FIGS. 3A and 4) as the closure top is pivoted from the released position to the fully open position.

While in the foregoing description, the manipulation has been described of the closure top 22 by downward pressure on the finger tab 22 to release the locking means, the finger tab 14 also provides an extension by which the closure top may be pivoted from the open position to the closed position. Thus, the closure top 22 when swung toward the closed position is locked in the closed position by the ridge locking element 28 on the neck 18 after the closure flange 24 is moved axially onto the neck by pivotal movement of the closure top 22 produced by upward force applied to the finger tab 14. As the closure flange 24 moves axially onto the neck 18 of the flask 10, the seat 30 on the flange first engages the locking element 28 to hold the closure top in the vented closed position; further axial movement of the flange 24 will cause the second seat 32 to be seated by a snap action on the ridge locking element 28 to lock the closure top in the fully closed position.

As a further feature of the invention, venting means for the closure top 22 may be provided with the closure top 22 in the fully closed position (and the vent passage P closed as in FIG. 2) by having an opening 58 in the center of the closure top covered by a membrane M (on top of or underside the closure top) which is permeable to gas and impermeable to microbes. While in the embodiments of FIGS. 1A, 2 the closure top 22 has an opening and membrane M, and provides a vent passage P in the closed and vented position (FIG. 3A) in other embodiments of the invention (FIGS. 1B, 3B, 6–11) the closure has no opening and membrane M, and venting means is provided by having a vent passage P in the position of the closure top shown in FIG. 3B (and not repeated for the other embodiments).

Figure 5:
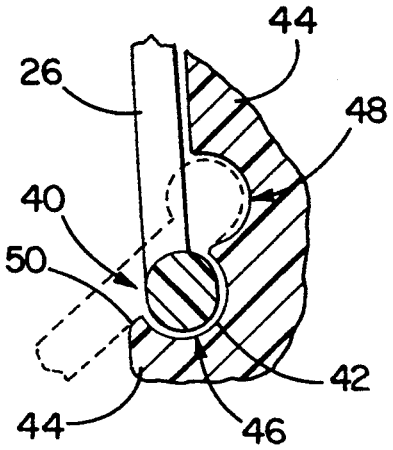
FIG. 5 is an enlarged fragmentary sectional view of portions of the hinge member and mounting for the hinge member of the invention embodiments shown in FIGS. 1–4.
Figure 6A:
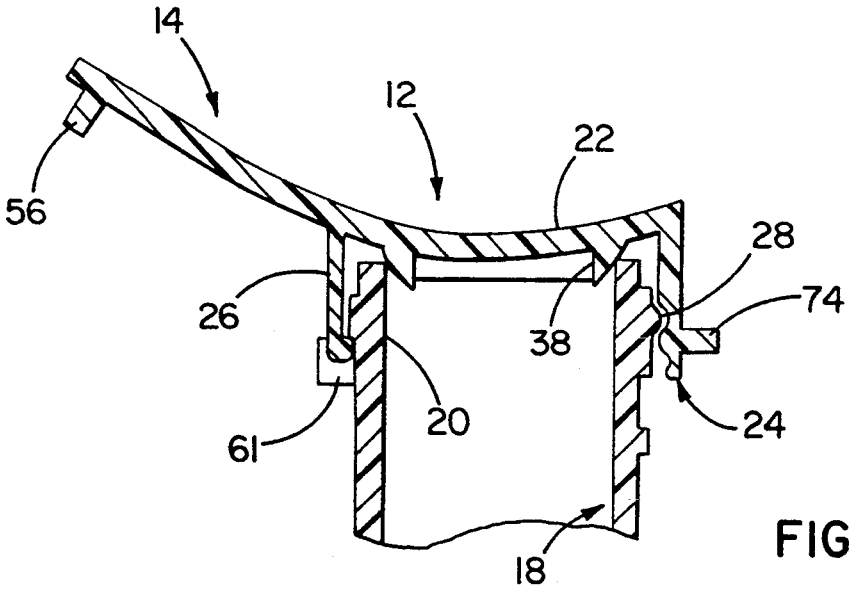
FIG. 6A is fragmentary vertical sectional view, similar to FIG. 1A, of an embodiment of flask and closure member according to the invention with an alternative form of hinge arrangement.
Figure 6B:
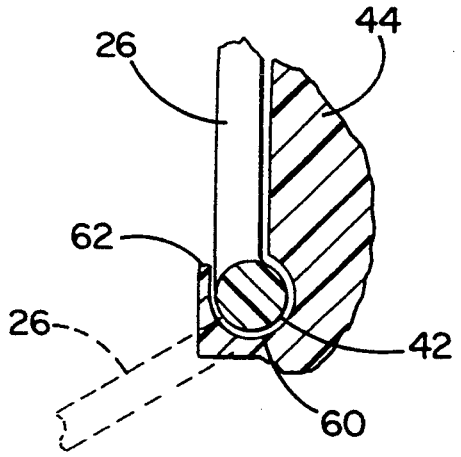
FIG. 6B is an enlarged fragmentary sectional view similar to FIG. 5 of the hinge member and mounting of the embodiment shown in FIG. 6.
Figure 6C:
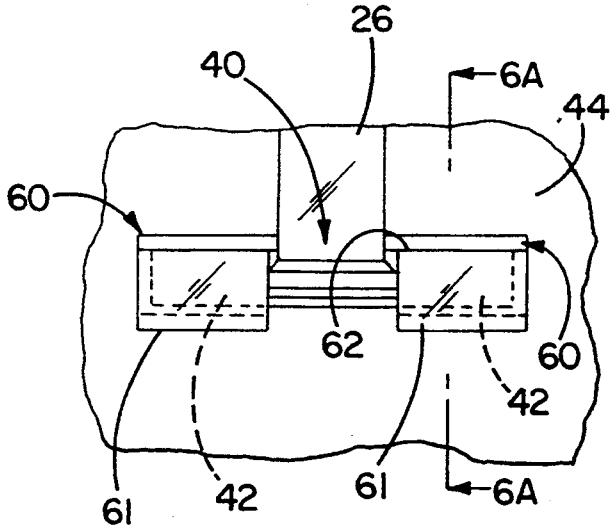
FIG. 6C is an enlarged fragmentary elevational view of the hinge arrangement taken from the lift in FIG. 6 and showing the spaced bosses supporting the base of the hinge.
Figure 6D:
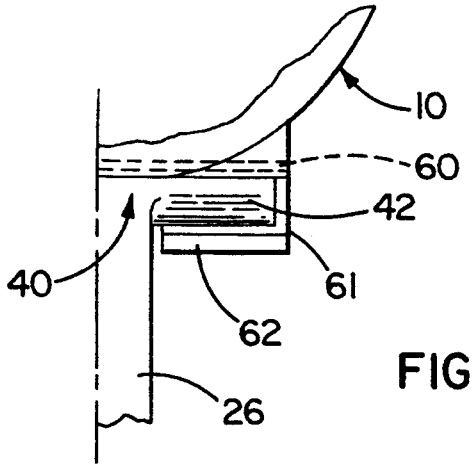
FIG. 6D is an enlarged fragmentary half plan view looking down on the hinge arrangement from above, with the finger tab swung down toward the fully open position so that it appears at about the position shown in dashed lines in FIG. 6B.

Further in carrying out the invention, referring to FIGS. 6A–6D, to provide a hinge member 26 which supports the closure top 22 for pivotal movement, without the base portion 40 the base portion 40 shifting between positions as shown in FIG. 5 (one position in solid lines, a second position in dashed lines), the hinge base portion 40 may be provided with hinge pins 42 as in the embodiment of FIGS. 1–5 but the mounting member 44 may be provided with a single recess 60, the mounting member 44 having a pair of spaced raised bosses 61 which are slotted so that the hinge pins 42 may be forced into the slot of the bosses 61 and into the recess 60 with a snap fit past the slot lip 62 which holds the hinge pins 42 in place. The hinge pins are held in the mounting member 44 and the bosses 61 and are rotatable in the recess 60 and in the bottom of the slot in the bosses 61 so that the hinge member 26 is pivotable (as shown between the solid line and dashed line positions in FIG. 6B) about the axis of the hinge pins such that as the closure top is pivoted toward the fully open position through the dashed line position of FIG. 6B the hinge member swings down between the space bosses 61 (as shown in FIG. 6D), with the hinge pins 42 turning in the bearings provided by the bosses 61. For this purpose the hinge pins 42 are rotationally fitted in the slot in the bosses 61.

In the embodiment of FIG. 6A–6C, the underside of the closure top 22 has an annular projection 38 which fits within the neck opening 20 and seals the opening when the closure top 22 is in the closed position of FIG. 6A. As mentioned, the closure top also has a vented closed position (not shown) like that shown in FIGS. 3A and 3B.

Figure 7:
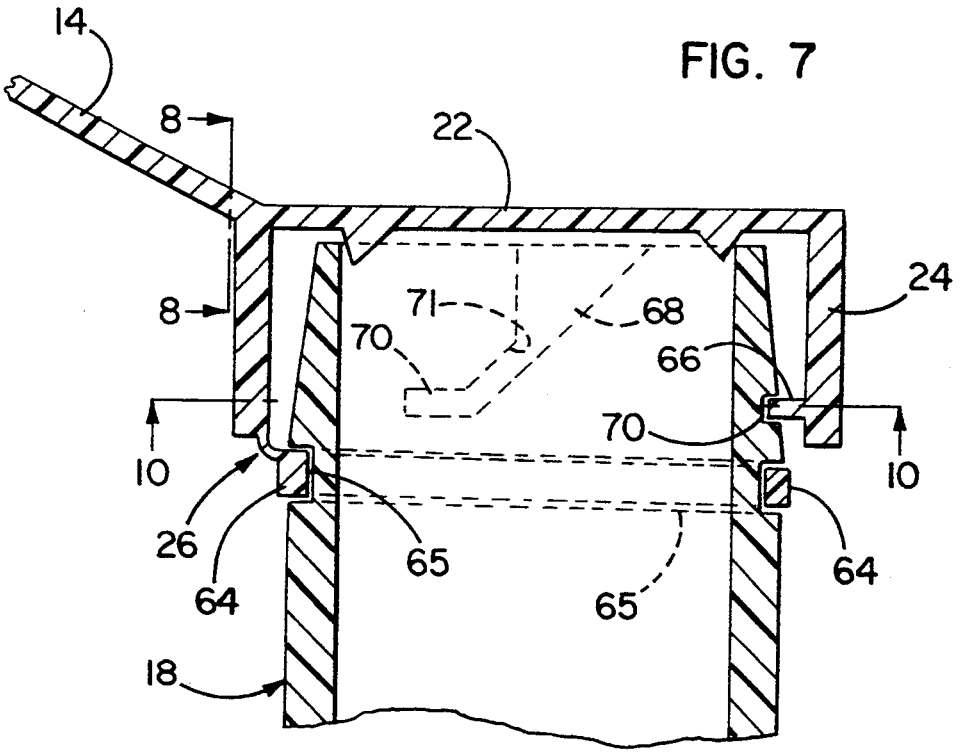
FIG. 7 is a vertical sectional view similar to FIGS. 1A and 6A of another embodiment of the invention, showing a bayonet-type locking means and rotationally mounted hinged closure mounted on a flask.
Figure 8:
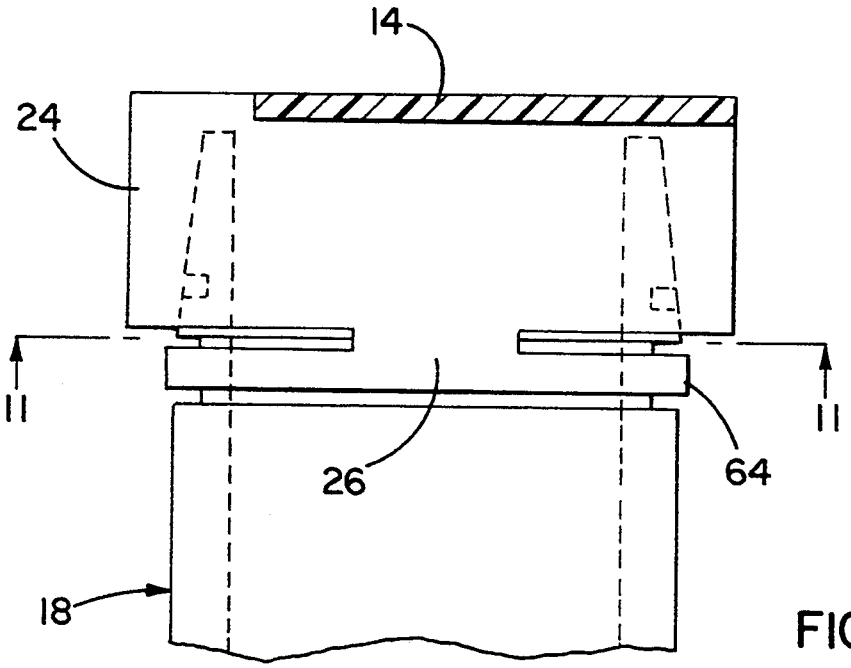
FIG. 8 is a side elevational view of the flask and closure of FIG. 7 taken as indicated by the lines 8—8 in FIG. 7.

In keeping with the invention, other types of locking arrangements besides the snap-type may be utilized to lock the closure top 22 in the closed position and other types of hinge arrangements may be utilized to support the top 22 for pivotal movement. For example, referring to FIGS. 7–11, a bayonet-type locking arrangement is shown which, like the other embodiments, may be locked or unlocked solely with one finger such as the thumb or forefinger when the flask is held by the remaining four fingers and within the palm of one hand. To this end, the closure top 22 in FIG. 7 is supported by a hinge member 26 which is secured to the flask neck 18 by a ring 64 which is rotationally mounted in a slot 65 which extends around the neck 18 to allow limited rotational movement of the closure top and the flange 24, which depends from the closure top 22, about the neck 18. The flange 24 which as shown is a rim extending around the top edge of the flask neck 18 and protects the top edge of the flask neck has laterally projecting bayonet-type locking lugs 66 each of which is of a size to slide axially in a corresponding axial slot 68 (FIG. 9) in the peripheral edge of the flask neck 18 to the bottom of an annular slot 70 in the flask neck 18. When the closure top 22 is rotated and the lugs 66 are moved fully into the annular slots 70, the closure top 22 is prevented from being accidentally opened. To aid in forcibly seating the annular sealing projection 38, each axial slot 68 has an inclined cam edge 71 which is engaged by the locking lug 66 to force the closure top 22 axially by camming action and press the annular sealing projection 38 against the inner edge of the opening at the top of the flask neck responsive to rotation of the closure top 22 by the finger tab 14 in closing and locking the closure top 22. The recess 70 is undercut below the top edge of the flask neck 18 such that when the closure flange 24 is moved axially to the solid line position of FIG. 7 to cover the top edge of the flask neck 18 upon pivotal movement of the closure top 22 allowed by the hinge member 26, each of the bayonet-type lugs 66 is received in and moved axially to the bottom of the corresponding vertical slot 68, and is then moved rotationally upon rotational movement of the closure top 22 and the closure flange 24. This rotational movement causes each locking lug 66 to slide into its annular slot 70 and under the lip 72 which overhangs the annular slot 70 to lock the closure top 22 in fully closed position. The locking element on the flask neck 18 in this embodiment of the invention is served by the annular lip 72 adjacent each vertical slot 68 which engages the corresponding locking bayonet-type lug 66 upon rotational movement of the closure top 22 and flange 24 following the axial movement to provide a bayonet-type locking action to hold the closure top 22 in the closed position.

While three lugs 66 are shown in detail, if desired a different number of such lugs may be provided at peripheral locations on the closure flange 24 with the top of the neck 18 provided with a matching plurality of axial slots to receive the lugs when the closure flange is moved axially on the flask neck, the locking element engaging the lugs upon rotational movement of the closure flange to provide the bayonet-type locking action.

Figure 9:
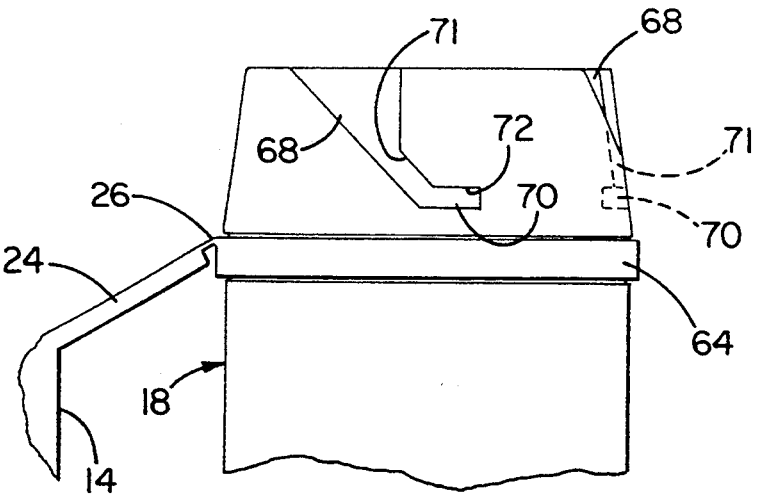
FIG. 9 is a front elevational view of the flask neck of FIG. 7 with the closure top in the fully open position, showing a gradually narrowing axial slot for receiving a bayonet-type lug on the closure top and a annular slot providing a locking element which engages the lug to lock the closure top on the flask neck.
Figure 10:
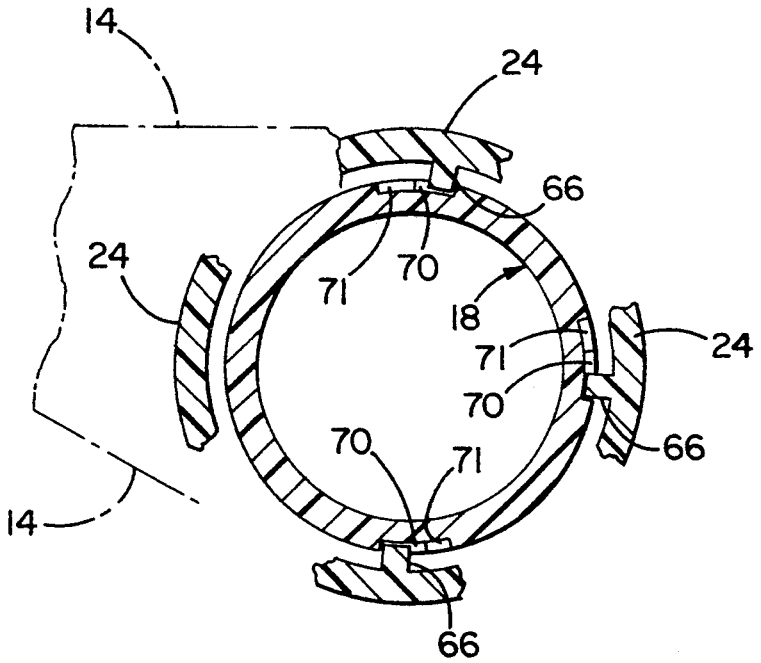
FIG. 10 is a horizontal sectional view taken as shown by the lines 10—10 in FIG. 7.
Figure 11:
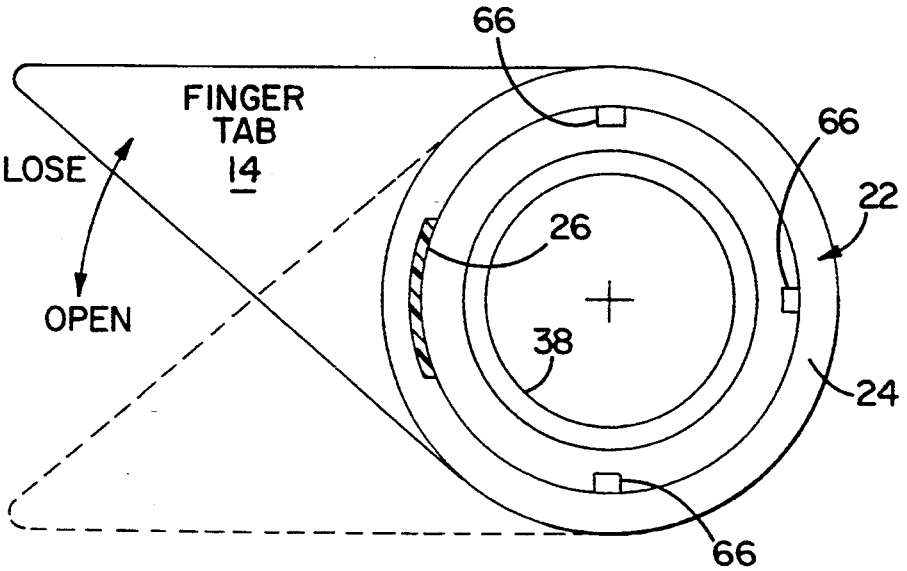
FIG. 11 is a bottom view of the closure top taken through the plane of the hinge as indicated by the lines 11—11 in FIG. 8.

The hinge member 26 in the embodiment of FIG. 7 is preferably served by a thin flexible element at the base portion 40 connecting the flange 24 to the band 64. The closure top 22, flange 24, hinge member 26 and band 64 may be made in one piece or separately and assembled; the hinge member is preferably of a suitable plastic such as polypropylene which has strength and flexibility to enable the closure top 22 to pivot about a hinge axis tangential to the flask neck 18 and move between the closed position of FIGS. 7–8 and the fully open position as illustrated in FIG. 9. With the closure top 22 being supported for rotational movement (about the vertical axis of the neck 18) by the ring 64 and hinge member 26, such rotational movement may be produced by one finger engaging the finger tab 14 at its side edge at a point spaced from the closure top 22 and applying force (the first stage) in a direction tangential to the flask opening, which provides leverage to overcome the resistance of the locking element lips 72 and cause each of the bayonet-type locking-lugs 66 to move peripherally to the axial slots 68 in the flask neck 18, and thereby release the lugs 66 from engagement by the locking element herein shown as the overhanging lips 72 of the annular slots 70. The finger tab 14 may then be manipulated by the same one finger (the second stage) by pressing down on the finger tab 14 to pivot the closure top 22 about the hinge axis and thereby raise the closure top 22 from the closed position and swing the top 22 to the fully open position. It is preferred that the arrangement of the hinge member 26 and the closure top 22 be such that the closure top remains in the fully open position when the flask is upright and is held there by itself if pressure is removed from the finger tab 14. A reverse sequence of manipulations of the closure top 22 by the finger tab 14 may be employed to move the closure top axially onto the flask neck followed by rotational movement to engage the bayonet-type lugs 22 with the locking element lips 72, as they move into the annular slots 70.

As a further feature of the invention, to facilitate releasing the locking means or engaging the locking means in the embodiments of FIGS. 1–6, a short locking tab 74 is provided preferably at a location diametrically opposite the finger tab 14. This locking tab 74 may be used to help push the closure top 22 axially onto the flask neck 18 or to help lift the closure top from the closed position.

Accordingly, in the various embodiments of the invention as disclosed, a cell culture flask with hinged closure is provided which is simple in construction and low cost and which overcomes the problems heretofore faced by flasks with closures which require two hands to open or close. According to this invention, the cell culture flask has a closure which may be opened or closed by one finger while the flask is held by the remaining finger and within the palm of one hand, leaving the other hand completely free to perform operations such as injecting or withdrawing samples from within the flash.

What is claimed is:

1. A cell culture flask comprising:

a container having a neck, the neck having an axis and an opening in an opening plane transverse to the axis providing access to inside the container for a pipette through the neck opening, a hinged closure having a top which covers the neck opening, and a flange which depends from the top outside the neck opening when the closure top is in a closed position, the flange having a locking lug which projects laterally from the flange, closure hinge means and locking means secured to the neck including:

a hinge member supporting the closure top for pivotal movement from the closed position to a fully open position at which it and the flange are located away from an axial projection of the neck opening, a locking element outside the neck which locks the closure top in the closed position after the closure flange is moved axially onto the neck by engaging and resisting movement of the locking lug, and means for manipulating the closure to engage or release the locking means and for moving the closure top between the closed and fully open positions solely by one finger when the flask is held by the remaining four fingers and within the palm of one hand including:

a finger tab which has an elongated portion which extends radially relative to the neck axis from the closure top at a location adjacent the hinge member in a direction generally parallel to the opening plane, when the closure top is in the closed position, and in a direction generally perpendicular to the opening plane, when the closure top is in the fully open position, the elongated portion of the finger tab presenting an extension spaced radially from the closure top which allows the one finger of the one hand to move the closure top, when locked in the closed position, solely via force produced by the one finger, applied to the finger tab, and transmitted through the finger tab to the closure top in first and second stages, a first-stage wherein the finger tab which extends from the closure top provides leverage to overcome resistance by the locking element to movement of the locking lug as the closure top is moved responsive to the force applied by the one finger in a direction which releases the locking lug from engagement by the locking element, and a second stage wherein the closure top is pivoted toward the fully open position.

2. A cell culture flask according to claim 1 further comprising means for venting the flask when the closure top is in the closed position.

3. A cell culture flask according to claim 2 wherein the venting means includes an opening to surrounding atmosphere in the top of the closure and a filter across the opening which is permeable to gas and impermeable to microbes.

4. A cell culture flask according to claim 2 wherein a vent passage is present between the locking element and the closure flange when the closure top is in the closed position, and the locking means includes a sealing surface on the neck which is engaged by the closure top and cooperates therewith to provide a seal when the closure flange is pushed axially onto the neck to a second closed position of the closure top.

5. A cell culture flask according to claim 1 wherein the finger tab is arranged relative to the closure top such that when the flask is upright and the closure top is in the fully open position, the center of gravity (CG) of the closure top is located outwardly, relative to the flask, of a vertical line passing through the hinge member, whereby the closure top is held in the fully open position by its own weight.

6. A cell culture flask according to claim 5 wherein the hinge member is mounted for pivotal movement about a hinge axis tangential to the flask neck, and the CG is located outwardly of a vertical line passing through the hinge axis.

7. A cell culture flask according to claim 1 wherein the lug projecting from the flange and the locking element of the locking means engage with a snap fit when the closure flange is pushed axially onto the flask neck.

8. A cell culture flask according to claim 1 wherein the locking element of the locking means is provided with at least one axial slot and a connected annular slot to receive the lug projecting from the flange when the closure flange is moved axially onto the flask neck, the locking element engaging the lug upon rotational movement of the closure flange into the annular slot following the axial movement to provide a bayonet-type locking action to hold the closure top in the closed position.

9. A cell culture flask according to claim 8 wherein the flange has a plurality of locking lugs which project laterally and the locking element is provided with a matching plurality of slots to receive the lugs when the closure flange is moved axially onto the flask neck, the locking element engaging the lugs upon rotational movement of the closure flange to provide a bayonet-type locking action.

10. A cell culture flask according to claim 8 wherein the hinge member of the closure hinge means is secured to a mounting member which is rotationally mounted on the flask neck to allow rotational movement of the closure flange.

11. A cell culture flask according to claim 10 wherein the mounting member is a ring which is rotationally mounted on the flask neck.

12. A cell culture flask according to claim 1 wherein the closure hinge means includes the hinge member which is mounted for pivotal movement about a hinge axis tangential to the flask neck, the hinge member having a base portion with oppositely projecting hinge pins, and a mounting member which is secured on the flask neck and is slotted to receive the hinge pins and position the hinge pins along the hinge axis, the hinge pins being rotatably mounted on the mounting member.

13. A cell culture flask according to claim 1 wherein the finger tab is arranged relative to the closure top such that when the flask is upright and the axis of the neck is vertical, the finger tab extends radially with respect to the axis of the neck and includes an inclined portion which extends at an angle to the opening plane.

14. A cell culture flask according to claim 1 wherein the finger tab presents an extension which allows the one finger of the one hand to apply force at a point spaced from a pivotal axis of the closure top, the closure top being mounted for pivotal movement, when in the closed position, in a direction which releases the locking lug from engagement by the locking element responsive to force applied to the finger tab at that point.

15. A cell culture flask according to claim 14 wherein the pivotal movement of the closure top is for rotational movement about the flask neck, when in the closed position, to locate a locking lug on the flange of the closure top in axial alignment with an axial slot in the locking element so that the locking means may be released upon pivotal movement of the closure top from the closed position toward the fully open position.

16. A cell culture flask having a neck, the neck having an axis and an opening, and a hinged closure supported on the neck, the hinged closure including a closure top which covers the flask opening and a locking arrangement, the locking arrangement including a locking element outside the flask neck which cooperates with a locking lug on the closure top to hold the closure top in a closed position after it is moved axially onto the flask neck, a finger tab for manipulating the hinged closure to engage or release the locking arrangement and to move the closure top between the closed and fully open positions solely by one finger when the flask is held by the remaining four fingers and within the palm of one hand, the finger tab having an elongated portion extending from the closure top radially relative to the neck axis and presenting an extension radially spaced from the closure top, when the closure top is in the closed position, which allows the one finger of the one hand to move the closure top, when locked in the closed position, solely via force produced by the one finger, applied to the finger tab, and transmitted through the finger tab to the closure top in first and second stages, a first stage wherein the elongated portion of the finger tab which extends radially from the closure top provides leverage to overcome resistance by the locking element to movement as the closure top is moved responsive to the force applied by the one finger in a direction which releases the locking element, and a second stage wherein the closure top is pivoted toward the fully open position.

17. A cell culture flask according to claim 16 wherein the finger tab extends generally perpendicular to the flask neck when the closure top is in the closed position.

18. A cell culture flask according to claim 16 further including a locking tab projecting from the closure top at a location adjacent the locking lug, which facilitates moving the closure top axially on the flask neck by application of force axially to the locking tab to engage or release the locking arrangement.

* * * * *